US007694717B2

(12) United States Patent
Bonner et al.

(10) Patent No.: US 7,694,717 B2
(45) Date of Patent: Apr. 13, 2010

(54) PROFILE TRACED INSULATED COVER ASSEMBLY

(76) Inventors: Michael R. Bonner, 2320 Pleasant View Dr., Rochester, MI (US) 48308; Willem A. Cline, 5783 Clear View, Troy, MI (US) 48098

( * ) Notice: Subject to any disclaimer, the term of this patent is extended or adjusted under 35 U.S.C. 154(b) by 1202 days.

(21) Appl. No.: 10/540,542

(22) PCT Filed: Dec. 17, 2003

(86) PCT No.: PCT/US03/39995

§ 371 (c)(1),
(2), (4) Date: Jun. 24, 2005

(87) PCT Pub. No.: WO2004/059233

PCT Pub. Date: Jul. 15, 2004

(65) Prior Publication Data

US 2006/0016579 A1 Jan. 26, 2006

Related U.S. Application Data

(60) Provisional application No. 60/436,546, filed on Dec. 24, 2002.

(51) Int. Cl.
*F28F 1/02* (2006.01)

(52) U.S. Cl. ..... 165/80.1; 165/80.5; 165/164

(58) Field of Classification Search ..... 165/80.1, 165/80.5, 164
See application file for complete search history.

(56) References Cited

U.S. PATENT DOCUMENTS

| | | | | |
|---|---|---|---|---|
| 2,000,906 | A * | 5/1935 | Turner | 122/479.1 |
| 2,650,801 | A * | 9/1953 | Collito | 165/164 |
| 2,982,992 | A * | 5/1961 | Brown et al. | 425/87 |
| 3,782,452 | A | 1/1974 | Ceplon | |
| 3,834,458 | A | 9/1974 | Bilbro et al. | |
| 3,844,345 | A * | 10/1974 | Evans et al. | 166/72 |
| 4,194,536 | A * | 3/1980 | Stine et al. | 138/149 |
| 4,203,186 | A * | 5/1980 | Horner | 29/890.045 |
| 4,347,433 | A | 8/1982 | Wojtecki et al. | |
| 4,497,365 | A * | 2/1985 | Boyer | 165/164 |
| 5,363,907 | A | 11/1994 | Dunning et al. | |
| 5,548,965 | A | 8/1996 | Chen et al. | |
| 5,714,738 | A * | 2/1998 | Hauschulz et al. | 219/535 |
| 6,595,241 | B2 * | 7/2003 | Chen | 138/38 |
| 2004/0079431 | A1 * | 4/2004 | Kissell | 138/149 |

OTHER PUBLICATIONS

International Search Report dated Jun. 9, 2004 for PCT/US03/39995 (3 pages).

* cited by examiner

*Primary Examiner*—Allen J Flanigan
(74) *Attorney, Agent, or Firm*—Young Basile P.C.

(57) ABSTRACT

A cover assembly (10) is provided and includes a flexible fabric cover (21) within which a plurality of elongate, hollow thermal transfer fluid profiles (12) is positioned. Each of the profiles includes an arcuate outer surface (13) adapted to conform with an exterior of a fluid conduit (20). The cover assembly may be fastened circumferentially about a fluid conduit to position and maintain the profiles in thermal contact therewith.

10 Claims, 2 Drawing Sheets

FIG. 1.
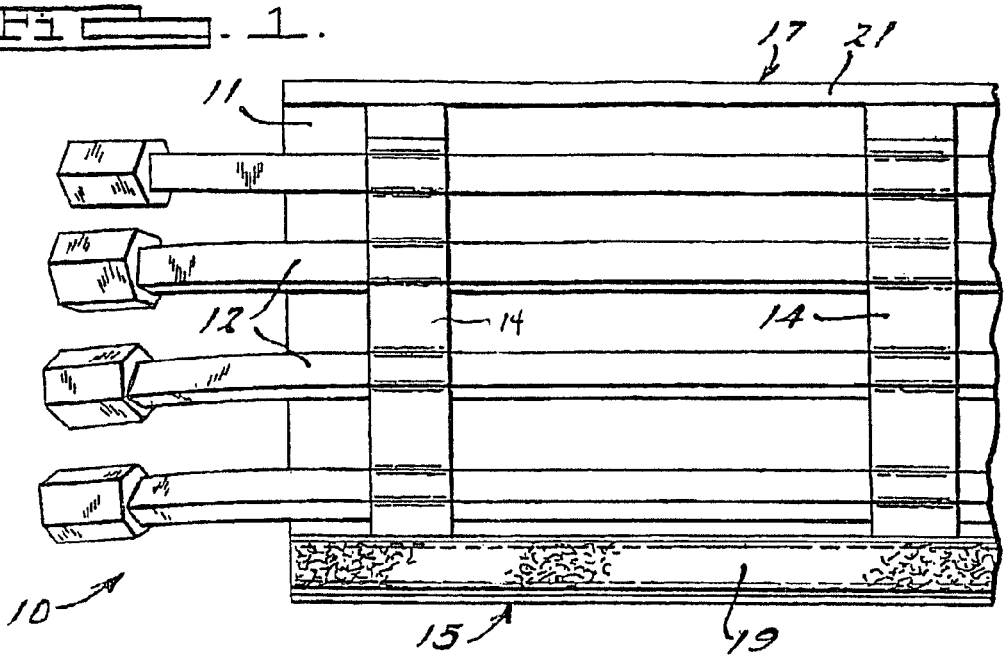
FIG. 2.
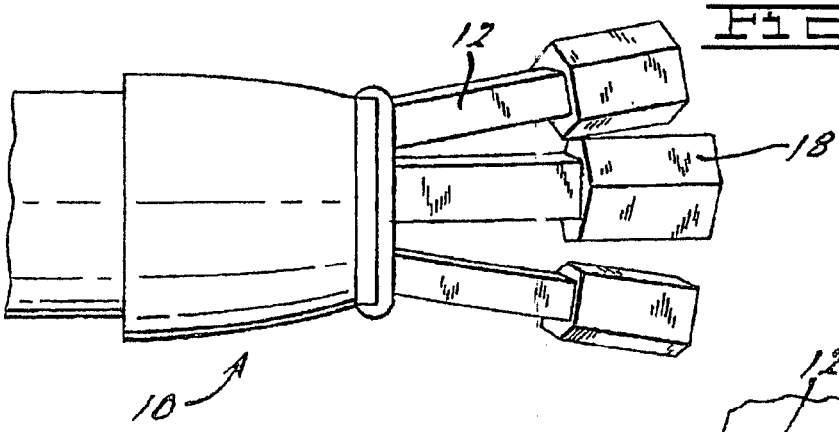
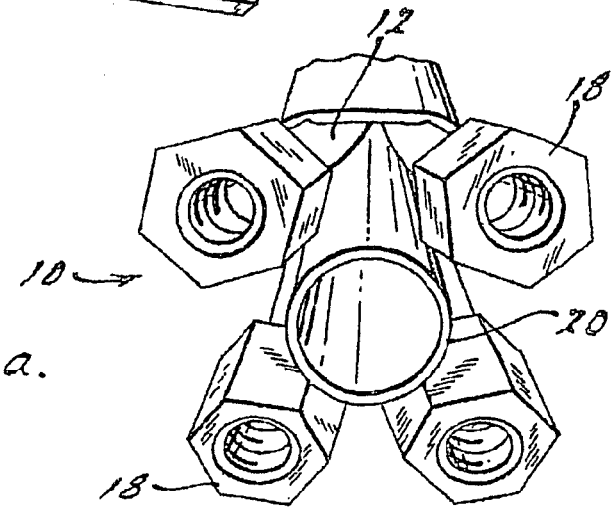
FIG. 2a.

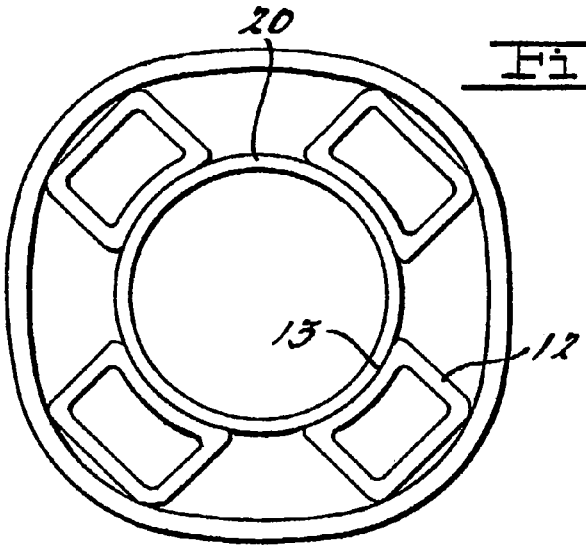
Fig. 3.
Fig. 4.
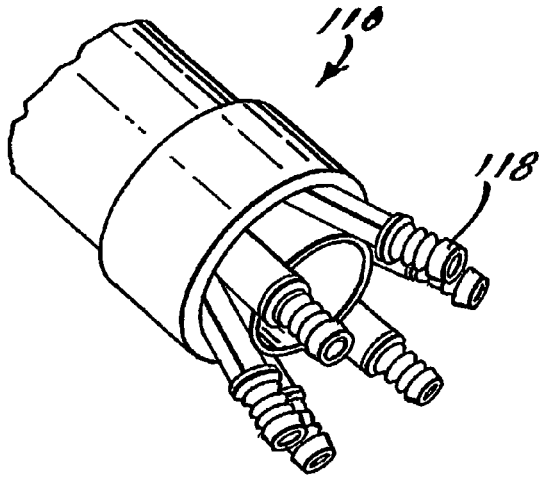
Fig. 5
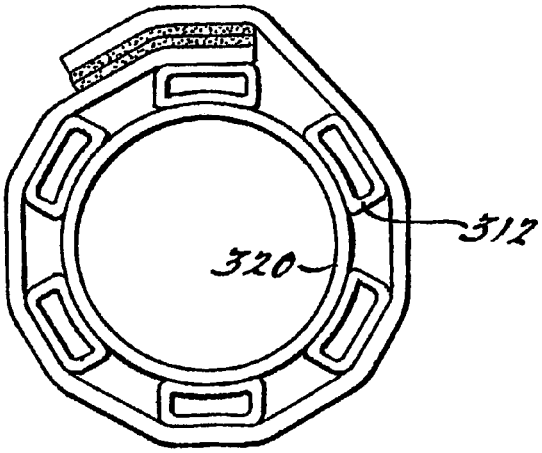
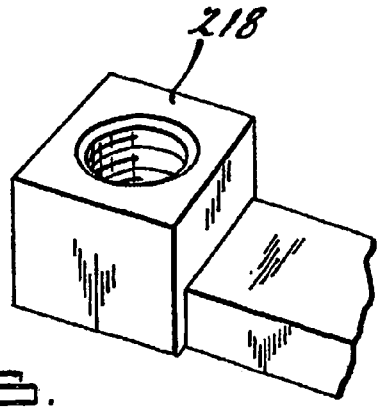
Fig. 6.

PROFILE TRACED INSULATED COVER ASSEMBLY

CROSS-REFERENCE TO RELATED APPLICATIONS

This application is a National Stage of International Application No. PCT/US03/39995, filed on Dec. 17, 2003, which claims priority to U.S. Provisional Patent Application Ser. No. 60/436,546, filed on Dec. 24, 2002. The disclosures of the above applications are incorporated herein by reference.

This Application claims the Benefit of the Filing Date of U.S. Provisional Patent Application Ser. No. 60/436,546, Filed Dec. 24, 2002 and Hereby Incorporated By Reference.

TECHNICAL FIELD

The present invention relates generally to heat exchanger systems for pipes, and more particularly to such a system utilizing a readily installed flexible cover assembly having a plurality of thermally conductive fluid transfer profiles maintained in thermal contact with the pipe.

BACKGROUND OF THE INVENTION

There are a wide variety of applications where heated or cooled fluid is delivered over a length of conduit Typical industrial applications include fluid coatings or adhesives that are applied at specific assembly or processing stations in a plant. The fluid may be stored in an area remote from the one or more dispensing stations. However, it is often advantageous to control the temperature of the fluid, whether to lower the viscosity to facilitate fluid transfer or to maintain a desired temperature at the point of application, as a matter of application process efficiency. It is generally preferred to perform the bulk temperature control at the point of introducing the fluid into the system, particularly where there are multiple application points. During delivery of the fluid to the application station, a change in fluid temperature will result if the ambient temperature varies from the initial control temperature. The temperature gradient increases as the difference between the ambient temperature and control temperature increases, and as the length of the conduit increases.

Other fluid delivery systems require the routing of fluid conduits carrying ambient temperature fluids through relatively cold or hot environments. For example, pipes carrying room temperature water through an outside environment may freeze up if the ambient temperature drops significantly below the freezing point of water. The pipes must then be heated, melting internal ice to restore flow until the ambient temperatures rise sufficiently. It is well known to insulate such pipes with a variety of insulating wraps or foams, however, in severe conditions such measures are often insufficient to prevent freezing of the liquid passing through the pipe.

Accordingly, in many fluid delivery systems it is desirable to actively reduce temperature variation along the conduit or even adjust the temperature along the conduit. U.S. Pat. No. 5,363,907 to Dunning et al. shows an example of one such system, whereby installation of a heat exchanger to an existing system without disassembly is possible. This design represents a substantial improvement over many earlier methods which required cutting, welding, or similar processes to install a coaxial heat exchanging system. Unless installed at the time of system construction, prior methods required separating the pipe to be heated, draining and purging the pipe, then sliding a larger section of pipe over the subject pipe. The exterior pipe could be used to circulate fluid past the interior pipe in a coaxial relationship. Once this was done, however, both the exterior pipe and the internal, subject pipe had to be welded or otherwise sealed, a time-intensive, potentially dangerous and costly prospect. The multiple sealing points further presented an added risk of leaks (in either the heated system or the exterior heating pipe) that can foul or damage the system and require downtime for maintenance. Because water is typically used as the heating fluid, corrosion tends to cause leaks whereby material can pass into the water stream or water can pass into the material in the inner pipe, having dire consequences.

For example, in systems where hot urethane material is transferred through a pipe, the accidental introduction of even a small quantity of water can cause solidification of the material within the entire system, ruining much of the equipment. Furthermore, many such systems utilize flammable, caustic or otherwise dangerous materials in their operation, often creating significant disposal and safety issues. Moreover, the systems must often be cleaned with toxic or flammable materials to prepare the system for reintroduction of fluid material.

In light of the above concerns, it is desirable to reduce material usage and labor. Further, obviating the need to drain and cut into an existing system would provide a significant improvement in safety.

SUMMARY OF THE INVENTION

It is an object of the present invention to provide an efficient, safe means for adjusting or maintaining the temperature of material in a fluid conduit.

It is a further object of the present invention to provide an easily installed and efficiently operated heat exchanger system for insulating and regulating the temperature of material in a fluid conduit, wherein the system positions a plurality of thermally conductive fluid transfer profiles in thermal contact with the fluid conduit.

In accordance with the foregoing and other objects, the present invention preferably comprises a flexible cover that can be fastened about a fluid conduit, the flexible cover preferably including a plurality of thermally conductive fluid transfer profiles positioned therein, each of the profiles having a longitudinal surface contoured to substantially mate or conform with a longitudinal surface of the fluid conduit. Fastening of the cover preferably engages the fluid transfer profiles in intimate, thermal contact with the fluid conduit.

BRIEF DESCRIPTION OF THE DRAWINGS

FIG. 1 is a perspective view of an unfastened cover assembly according to a preferred embodiment of the present invention;

FIG. 2 is a close-up perspective view of a cover assembly fastened about a pipe according to a preferred embodiment of the present invention;

FIG. 2*a* is an end view of a cover assembly similar to FIG. 2;

FIG. 3 is an end view of a cover assembly according to one preferred embodiment of the present invention;

FIG. 4 is a close-up perspective view of a cover assembly fastened about a pipe according to another preferred embodiment of the present invention;

FIG. 5 is an end view of a cover assembly according to another preferred embodiment of the present invention;

FIG. 6 is a perspective view of positioning profiles having right-angle fittings, in accordance with another preferred embodiment of the present invention.

DETAILED DESCRIPTION OF PREFERRED EMBODIMENTS

The present invention comprises a cover assembly that serves as an insulator and heat exchanger with a conventional fluid transfer conduit such as a pipe. The cover assembly can be quickly and easily wrapped about a pipe and connected to a supply of heated or chilled fluid to regulate the temperature of the subject pipe and its contents. Referring to FIG. 1, there is shown an exemplary cover assembly 10 that includes a flexible cover 11, within which a plurality of thermally conductive fluid transfer profiles 12 are positioned. When unwrapped, as shown in FIG. 1, cover assembly 10 is preferably substantially rectangular, and can be joined when wrapped along longitudinal, preferably parallel edges 15 and 17. In a preferred embodiment, flexible cover 11 is wrapped around a pipe, bringing fluid transfer profiles 12 into thermal contact with the pipe. The phrase "thermal contact" should be understood to mean both direct physical contact and indirect contact via an intermediate thermally conductive material, as described herein. A heated (or chilled) thermal transfer fluid may then be passed through the profiles 12, directly absorbing or delivering thermal energy to the pipe and the material contained therein via heat exchange across the surfaces placed in thermal contact. In addition, the air temperature in the space created by the wrapped cover assembly is affected by the temperature of the fluid in profiles 12. Contact between this heated or chilled air and the surface of the pipe further enhances the insulating and/or adjusting effect of cover assembly 10, although it should be appreciated that the primary temperature control of the subject pipe is achieved via the thermal exchange across the portions of the fluid transfer profiles in thermal contact with the pipe.

Where greater or lesser temperature adjustment of the subject pipe is desired, the temperature and/or flow rate of fluid in profiles 12 can be adjusted. Further, flow of the thermal transfer fluid may be restricted to fewer than all the profiles 12. Although counter-directional flow is generally preferred, i.e. opposite flow between the thermal transfer fluid and the fluid carried within the conduit, the present invention is not limited thereto. It should be appreciated that although the present invention is contemplated for use primarily as a means for heating pipes containing incompressible fluids, it is similarly applicable where it is desirable to chill a pipe and its contents, or where the pipe transfers compressible fluids. Thus, as recited herein, references to "heating" the subject pipe should not be construed to limit the scope of the present invention. The cover assembly described herein will find similar utility in raising, lowering or maintaining the temperatures of a pipe and its contents.

Cover 11 is preferably formed from a rectangular flexible layered fabric that can be wrapped around the pipe that is to be heated, forming a substantially cylindrical sleeve there around. Although conventional fabrics are preferred for most applications, for instance woven polyesters or other common polymers, where the temperatures encountered are relatively great, highly heat-resistance polymers or other suitable, non-polymeric materials may be used. Because cover 11 is preferably formed from multiple layers of material, various insulating layers may be incorporated therein, both to enhance the heat-resistance of the cover material itself and to improve the temperature control capabilities of the cover assembly, as described herein. In one preferred method of manufacturing the cover, one or more layers of flexible insulation material, for instance fiberglass, is/are affixed between two layers of durable polymeric fabric. The layers can be glued, riveted, ultrasonically or thermally welded, or attached by any other known means. In a preferred embodiment, the layers are sewn together. Various combinations of insulating, protective or decorative materials may be used.

Cover assembly 10 is primarily contemplated for use in established systems that require, for example, supplementary heating or cooling, however, cover assembly 10 might also be incorporated as part of an original system design. An attachment means comprising a releasable engagement of a longitudinal strip having a plurality of plastic hooks 19 with a longitudinal strip having a plurality of plastic loops 21, as known by the trade name Velcro®, may be used to secure cover 11 about the subject pipe. Other embodiments are contemplated, however, in which a zipper, buttons, hooks, clasps, tape or some other attachment means is utilized without departing from the scope of the present invention. Because it is desirable to effectively thermally isolate the environment within the wrapped cover from ambient, attachment means are preferred which substantially block air exchange along the attached longitudinal edges of the cover 19 and 21. The dimensions of cover 11 are variable, and will be greater or lesser depending on the length and diameter of the pipe whose temperature is to be adjusted.

Cover assembly 10 preferably further includes a plurality of retaining straps 14 sewn to the inside of cover 11. Straps 14 are preferably formed from a strip of material sewn at multiple locations across cover 11 to create a plurality of loops adapted to receive profiles 12. Other attachment means are contemplated, such as welds or glue, as well as the use of individual straps. Further still, it is not necessary that cover 10 positively retain profiles 12 when in a disassembled state at all, as alternative embodiments are contemplated wherein cover 10 is simply wrapped about profiles 12 that are otherwise held about a pipe. Once cover 10 is secured, the engagement of the cover edges 17 and 19 can serve to secure the profiles 12 in their desired orientations/positions. Still further embodiments are contemplated wherein cover 11 is provided with sleeves sewn to, or integral with, the layered cover. Profiles 12 are preferably inserted into straps 14, which assist in positioning profiles 12 when cover assembly 10 is engaged with a pipe. Two sets of straps are preferably provided, and are positioned at opposite ends of cover 11 such that a strap is engaged with each profile at opposite ends. The straps may be formed from any suitable material, for example, elastic tape and may be formed from a thermally conducting material if desired. It should be appreciated, however, that straps 14 are preferably fabricated such that they create a minimal gap between profile 12 and the subject pipe. In addition, it is preferred to use straps that have a relatively small width, to maximize the area of contact between the profiles and the pipe.

Various alternative embodiments are contemplated wherein a cord or strap, for example a zip-tie, is fed through cover 11 or around its exterior, and secured to assist in holding cover assembly 10 snugly against the pipe. One example of such an embodiment (not shown) includes a plurality of conventional, commercially available plastic zip-ties passed through channels in cover 11 that are oriented substantially perpendicular to the orientation of profiles 12. Thus, once cover assembly 10 is engaged about the pipe, the zip-ties can be engaged and tightened, constricting cover 11 about the pipe, and assisting in positioning profiles 12 in thermal contact therewith. Similar designs (also not shown) use straps that can be sewn, for instance, to the interior of cover 11, or passed through channels therein. The respective ends of the straps are preferably fitted with mating buckles or hooks that can be engaged, and the straps tightened about cover assembly 10.

While a preferred embodiment of the present invention has been described in which a flexible, fabric cover is utilized, it should be appreciated that alternative embodiments are contemplated. For example, a relatively rigid, multi-piece hinged cover might be substituted so long as the profiles can be brought into thermal contact with the pipe when the cover is engaged therewith.

In a preferred embodiment, the profiles are positioned substantially radially symmetrically about the pipe. Referring now in addition to FIGS. 2 and 2*a*, there are shown side and end views, respectively, of cover assembly 10, similar to FIG. 1. FIGS. 2 and 2*a* illustrate the preferred positioning of profiles 12 about a pipe 20. As also shown in FIGS. 2 and 2*a*, profiles 12 preferably include internally threaded fittings 18 at their ends for in-line connection with a fluid circulation/distribution system. In addition, profiles 12 are preferably bent radially outwardly relative to a longitudinal axis of the pipe proximate the points at which profiles 12 are connected to the rest of the system, i.e. at the fittings 18. The outward bend of profiles 12 facilitates attachment with supply/drain lines, hoses, etc. Referring to FIG. 4, there is shown a cover assembly 110 incorporating "barbed" fittings 118 for engagement with a resilient mate, for instance, a flexible hose. FIG. 6 illustrates yet another alternative, in which a right-angle fitting 218 is utilized. By utilizing profiles according to the FIG. 6 embodiment, cover assembly 10 can be more easily utilized in environments where space is at a premium, for example, and it is advantageous to attach cover assembly 10 to perpendicular fluid supply/drain lines.

Profiles 12 are preferably elongate hollow members suitable for circulating a suitable heat transfer fluid. It is contemplated that a wide variety of fluids might be utilized as the heat conductor in the present invention. Propylene glycol or similar materials, various mineral and organic oils, water and other fluids, both compressible and incompressible, might be used, depending on the heat transfer needs of the system, materials, and operating temperatures. Referring to the drawing Figures generally, profiles 12 may be fabricated from any suitable, thermally conductive material. Suitable metals include both ferrous and non-ferrous metals, although relatively soft metals such as copper or aluminum are particularly preferred. Softer metals tend to be easier to form to the desired shape, and often have a relatively greater thermal conductivity than harder metals. In addition to metals, embodiments are contemplated wherein thermally conductive plastics are used.

Profiles 12 may be formed by any known, suitable method. For example, the profiles may be extruded, roll-formed, molded, cast, milled or manufactured by some other process. Profiles 12 are preferably formed such that they have a concave surface substantially conforming with the subject pipe, typically substantially arcuate in cross section. FIG. 3 illustrates an exemplary assembly wherein profiles 12 have an inner surface 13 that substantially conforms with the exterior of a pipe 20. The mating/conforming relationship between the profiles 12 and pipe 20 optimizes the area of thermal contact, and thus optimizes the capacity to conduct heat therebetween. Accordingly, the present invention provides advantages over earlier designs that relied primarily upon heat conduction via the air within the cover assembly. Rather than air temperature serving as the primary influence over the temperature of the pipe and its contents, heat is primarily passed from the profiles directly to the pipe 20 (or via a thermally conductive gap filler, as described herein). Such a design provides for more efficient temperature control, as well as relatively quicker response time. Thus, rather than requiring a heat-up or cool-down time for the air within the cover before the temperature of the pipe is affected, heat transfer between the pipe 20 and its contents can begin substantially simultaneous with a change in the temperature of fluid passed through the profiles 12. Similarly, where it is desirable to simply maintain the pipe contents at a given temperature, heat transfer substantially directly from the profiles, rather than indirectly via air within the cover, allows for more efficient temperature regulation of the pipe and its contents. It is preferred that a heat-conducting gap filler (not shown) be placed between profiles 12 and pipe 20 to enhance thermal conductivity. There are many such materials known in the art, and various greases, pastes, creams, and gels are readily commercially available. Further still, there are numerous dry, thermally conductive foams and tapes known in the art and commercially available that may be applied, for example with a thermally conductive adhesive.

The cross sectional geometry of profiles 12 may be tailored for particular applications. For instance, profiles 12 might be fashioned to have a relatively greater area of radial surface contact with a pipe than the examples in the attached drawing Figures, and a correspondingly flatter cross section. Similarly, larger or smaller profiles can be used to increase or decrease the fluid flow capacity, or the effective area of surface contact with the pipe, depending on system requirements. The wall thickness of the profile along its side of contact with the pipe can also be adjusted to provide varying degrees and rates of thermal conductivity. Where it is desirable to heat a curved pipe, cover assembly 10 may be fashioned with bendable profiles 12 that can be bent in conformity with the pipe. In general, embodiments utilizing fewer profiles are preferred in order to minimize the number of fluid connections in the system, however, fluid flow rates tend to decrease with increasingly flattened profiles, and such profiles tend to be more challenging to manufacture. The embodiment pictured in FIG. 3 utilizes four profiles 12, with an exemplary 1" pipe 20. The FIG. 5 embodiment, on the other hand, utilizes six profiles 312, with an exemplary 2" pipe 320. The disclosed embodiments should not be considered limiting, and any number or conformation of profiles might be used without departing from the scope of the present invention.

A typical installation process utilizing a cover assembly according to the present invention begins by selecting an appropriately sized and designed cover assembly. Cover assemblies according to the present invention may be any length or size, or have essentially any number of fluid transfer profiles, limited only by the length and diameter of the pipe to be fitted, and the thermal exchange requirements of the system. Once the desired cover assembly is selected, the pipe surface is prepared. This may include cleaning or otherwise treating the pipe surface to ensure the most effective transfer of thermal energy. Before applying the cover assembly, a thermal transfer material such as thermal transfer grease is preferably applied longitudinally along the arcuate surfaces of the profiles that are to be placed in thermal contact with the pipe. The pipe itself might alternatively be coated with the thermal transfer material. The cover is then wrapped circumferentially about the pipe and secured, preferably bringing the profiles into secure contact with the pipe, with the layer of thermal grease positioned between the pipe and profiles. Once secured, the profiles can be connected to the thermal transfer fluid circulation system in any known fashion.

The present description is for illustrative purposes only, and should not be construed to limit the breadth of the present invention in any way. Thus, those skilled in the art will appreciate that various modifications might be made to the presently disclosed embodiments without departing from the intended spirit and scope of the invention. Other aspects, features and advantages will be apparent upon an examination of the attached drawing Figures and appended claims.

The invention claimed is:

1. A cover assembly for regulating or adjusting the temperature of materials within a fluid conduit comprising:

a plurality of elongate fluid transfer profiles, each profile having a hollow interior for the passage of a thermal transfer fluid and an opposed exterior surface, said profile exterior surface including a concave exterior surface region extending along a length thereof;

a cover closable about said fluid transfer profiles and adapted to position and maintain said respective concave exterior surfaces in thermal contact with a fluid conduit, wherein the cover is adapted to position the profile in thermal contact with a fluid conduit, the cover comprising a flexible fabric having means for positioning each of said plurality of profiles at substantially radially symmetric positions about said fluid conduit and a plurality of straps attached to an inside of said cover for positioning said profiles.

2. The cover assembly of claim 1 comprising 4 profiles.

3. The cover assembly of claim 1 comprising 6 profiles.

4. The cover assembly claim 1 comprising a plurality of profiles formed from metal.

5. The cover assembly of claim 4 wherein said at least one fluid transfer profile is formed from a metal selected from the group consisting of copper and aluminum.

6. The cover assembly of claim 1 wherein said concave exterior surface comprises a portion of a substantially circular radius.

7. A cover assembly for a fluid transfer conduit comprising:

a flexible fabric cover having a first side and a second side, said cover being openable to a first substantially planar conformation, and closeable to a second substantially cylindrical conformation, said cover comprising means for attaching to itself in said second conformation, wherein said first side is oriented toward the fluid transfer conduit in said second conformation and said second side is oriented away from the fluid transfer conduit in said second conformation; and a plurality of elongate hollow profiles mounted in said cover, each of said profiles comprising a concave wall surface wherein the flexible fabric cover includes means for connecting the plurality of elongate hollow profiles to the first face of the cover, the mounting means attached to the first side of the flexible fabric cover, and wherein each of said profiles is substantially rectangular in cross section, each of said profiles comprising three substantially planar wall surfaces and an arcuate wall surface.

8. The cover assembly of claim 7 wherein each of said profiles has opposed end portions and wherein, in said first conformation, said end portions arc substantially uniformly out of a plane defined by said cover, and wherein in said second conformation said end portions arc substantially uniformly away from an axis of a cylinder defined by said cover.

9. A cover assembly for a fluid transfer conduit comprising:

a flexible fabric cover having a first side and a second side, said cover being openable to a first substantially planar conformation, and closeable to a second substantially cylindrical conformation, said cover comprising means for attaching to itself in said second conformation, wherein said first side is oriented toward the fluid transfer conduit in said second conformation and said second side is oriented away from the fluid transfer conduit in said second conformation; and a plurality of elongate hollow profiles mounted in said cover, each of said profiles comprising a concave wall surface, wherein the flexible fabric cover includes means for connecting the plurality of elongate hollow profiles to the first face of the cover, the mounting means attached to the first side of the flexible fabric cover, the connecting means including first and second fabric strips sewn to an inside of said cover at a plurality of locations, each of said strips defining a plurality of loops for receipt of a profile.

10. The cover assembly of claim 7 wherein said cover comprises a thermally insulating material.

* * * * *